United States Patent [19]

Brede et al.

[11] 4,393,779

[45] Jul. 19, 1983

[54] ELECTRIC DETONATOR ELEMENT

[75] Inventors: Uwe Brede; Horst Penner, both of Fürth, Fed. Rep. of Germany

[73] Assignee: Dynamit Nobel Aktiengesellschaft, Troisdorf, Fed. Rep. of Germany

[21] Appl. No.: 171,293

[22] Filed: Jul. 23, 1980

Related U.S. Application Data

[63] Continuation of Ser. No. 948,782, Oct. 5, 1978, abandoned.

[30] Foreign Application Priority Data

Oct. 20, 1977 [DE] Fed. Rep. of Germany ..... 2747163

[51] Int. Cl.[3] ..... F42B 5/08

[52] U.S. Cl. ..... 102/202.5; 102/202.9; 102/210

[58] Field of Search ..... 102/202.1–202.4, 102/202.9, 202.5, 210

[56] References Cited

U.S. PATENT DOCUMENTS

| | | | |
|---|---|---|---|
| 2,881,703 | 4/1959 | Volpert | 102/203 |
| 3,070,013 | 12/1962 | Backstein et al. | 102/28 W |
| 3,198,117 | 8/1965 | Purdy et al. | 102/28 W |
| 3,269,315 | 8/1966 | Gauld | 102/203 |
| 3,292,537 | 12/1966 | Goss, Jr. | 102/28 R |
| 3,669,022 | 6/1972 | Dahn et al. | 102/28 EB |
| 3,670,653 | 6/1972 | Lunt et al. | 102/218 |
| 3,725,671 | 4/1973 | Keister et al. | 102/203 |
| 3,882,324 | 5/1975 | Smolker et al. | 102/28 R |
| 4,137,851 | 2/1979 | Weidner | 102/218 |
| 4,145,970 | 3/1979 | Hedberg et al. | 102/218 |
| 4,350,096 | 9/1982 | Cannavo et al. | 102/202.5 |

*Primary Examiner*—Edward A. Miller

*Attorney, Agent, or Firm*—Antonelli, Terry & Wands

[57] ABSTRACT

An electrical detonator element including a support formed of an electrically nonconductive material with an ignition resistance and lead electrodes arranged thereon. An electrical circuit for enabling detonation is formed on the support and includes the ignition resistance and at least one electronic component each separately arranged on the support.

12 Claims, 16 Drawing Figures

ELECTRIC DETONATOR ELEMENT

Figure 1:
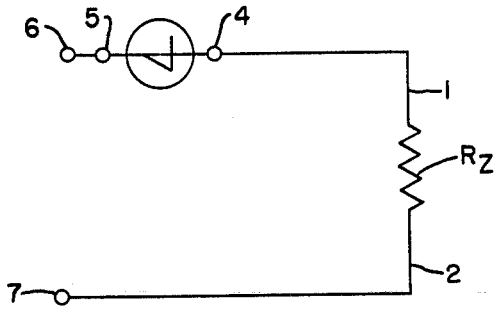

This is a continuation of application Ser. No. 948,782 filed Oct. 5, 1978, now abandoned.

The invention relates to an electrical detonator element of the type having a support of an electrically nonconductive material and with an ignition resistance arranged thereon with lead electrodes.

The electrical detonator element described in DOS [German Unexamined Laid-Open Application] No. 2,020,016, a so-called metal-layer detonating arrangement, is provided with a mechanically firm support made of electrically nonconductive material, such as glass or ceramic material having an ignition bridge formed with lead electrodes on the surface of the support. The ignition bridge and lead electrodes can be applied directly on the support and connected thereto over the entire surface by, for example, sputtering, pressure, and/or with chemical techniques. Instead of the ignition bridge, an ignition gap, i.e. a defined interruption between the lead electrodes formed on the support as conductor paths or conductor surfaces, can also be provided. The ignition bridge or ignition gap forms a resistance point between the lead electrodes and therefore will be generally designated as an ignition resistance in the following.

In another electrical detonator element described in DOS No. 1,771,889, a preferably circular disc shaped support is made of, for instance, laminated material, which consists of cellulose paper, cotton fabric, glass fiber fabric, synthetic fiber fabric, or the like, impregnated with a synthetic resin on the basis of phenol, epoxy, or unsaturated polyester. The ignition resistance and the lead electrodes can be formed on the support by being etched out of a metal foil cemented on the laminated material in accordance with the process for the manufacture of printed electrical circuits. Alternatively, they can also be placed directly on the support in the desired form by chemical and/or electroplating means.

Due to the firm connection over the entire surface between the ignition resistance with the lead electrodes and the support, these detonator elements have very advantageous mechanical properties, so that they withstand even the very great accelerative forces in automatic firearms. Furthermore, they can be manufactured, even in mass production, in a very economical manner with electrical properties which can be very precisely determined.

Moreover, an electrical detonator element has been known from DOS No. 1,910,665, wherein both filamentary lead electrodes of the ignition resistance of this detonator element are passed through the electrically nonconductive support. On the support is arranged a mechanically firm semiconductor, coated with two metal layers and having a voltage-dependent resistance. The metal layers are connected to the lead electrodes in the area of their rear ends, facing toward the support, while their front ends are interconnected by the ignition resistance. In this connection, the ignition resistance is a wire capable of incandescence or capable of being vaporized explosively which spans the front end, facing toward the primer charge, of the square-shaped semiconductor. Thus, the ignition resistance is arranged on the semiconductor, not on the support, with the semiconductor, in turn, being mounted on the support with the aid of the lead electrodes. The primer charge surrounds the ignition resistance in the manner of a primer pellet.

The semiconductor mades possible a protection of the detonator element against unintential ignition due to stray voltages, leakage currents, etc., in that the detonator element is only activated upon reaching a minimum ignition voltage which is set correspondingly high. Safety against electrostatic discharges is possible, if the detonator element is only activated up to a maximum ignition voltage, which is set suitably low. Insofar as an additional semiconductor is provided, which is arranged between one lead electrode and the external ignition voltage source, safety against both of the aforementioned influences can also be attained in that the voltage causing ignition is downwardly as well as upwardly limited in a specific manner.

This detonator element with an ignition resistance arranged on the semiconductor makes it possible to influence the ignition limits, however, only to a relatively slight extent, because the ignition resistance and the semiconductor are always electrically connected in parallel to each other due to the arrangement of the ignition resistance between the two metal layers of the semiconductor. In addition, the mechanical stressability of the detonator element is also not satisfactory, namely, especially when an additional semiconductor is provided. Finally, even in mass production, the expenditure required for a reproducible ignition behavior is undesirably high.

Finally, from DOS No. 1,933,377, there has been known an electrical detonator element which is combined with an electronic delay element consisting of resistor, capacitor, switching diode, and thyristor. The delay element forms a separate, independent unit which is held in direct contact with the actual detonator element by way of a contact spring, in that both elements are inserted into a common housing. This detonator element with the delay element takes up a relatively large area and can therefore only be used with difficulties, or often not at all. Additionally, the direct contact between the two elements diminishes operating safety because of changes in the contact resistance.

It is therefore an object of the present invention to provide an electrical detonator element of the type having a support of an electrically nonconductive material with an ignition resistance and electrical leads arranged thereon in such a way that the above-mentioned disadvantages, among others, can be avoided.

The properties of the detonator element, especially its electrical properties, will be capable of being set for a maximum number of different applications by utilizing different electronic components and/or different arrangements thereof. The detonator element will have a minimal total size and high operating safety even under unfavorable conditions, e.g. very long storage under poor environmental conditions or very great sudden stress. Moreover, the expense for the manufacture and the manufacturing tolerances should be minimal.

According to the present invention, there is provided an electrical detonator element of the type having a support of an electrically nonconductive material with an ignition resistance and electrical leads arranged thereon wherein an electric circuit is formed on the support includes the ignition resistance and at least one electronic component each separately arranged on the support. The electric circuit with connecting points for one, two, or several electronic components is formed with the aid of one of the conventional metallization techniques on the electrically nonconductive support made of, for example, ceramic material, glass, or laminated fabric. In this connection, the conductor paths of the circuit are preferably connected firmly in their whole surface area to the upper surface of the support. They are preferably applied according to the cathode sputtering technique, but can also be applied, for instance, according to the electroplating technique, the screen printing technique, or the vapor deposition technique. It is even possible to etch them out of metal foils cemented to the support.

The active and/or passive electronic components, such as diodes, transistors, thyristors, resistors, capacitors, coils, etc. are connected via their lead wires or connection surfaces to the conductor paths at the connection points provided therefor preferably by soldering. However, they could also be welded thereto or cemented thereto with the aid of an adhesive agent capable of conducting electricity. So-called chips with several or even a multitude of inter-linked switching elements and with correspondingly complex electrical properties can also be used, for instance, as modules, which chips may be anchored firmly to the support according to microwelding technology. In a bridge detonator structure, the ignition resistance can be formed e.g. as a wire capable of incandescence or capable of vaporizing explosively, the two ends of which are soldered, welded, or the like to the connection points in the circuit provided therefor. But insofar as the detonator element should exhibit electrical properties with especially little straying and very great mechanical strength, the ignition resistance just like the circuit is applied over the entire surface to the support, according to the preferred variant. For that purpose, the ignition resistance is comprised by a specific point in the conductor path of the circuit and can be embodied as an ignition bridge or an ignition gap, for example, in accordance with DOS No. 2,020,016.

In the detonator element according to the invention, the ignition resistance and the at least one electronic component are mounted on the support separate from each other and are electrically interconnected via the conductor paths. Because of this spatial separation of the ignition resistance and the preferably two or several electronic components, the individual elements can each be optimally formed and arranged independently, so that the detonator element is capable of being adapted to the respective application criteria in the best possible manner. The mechanically firm connection of the individual elements to the support insures the very great mechanical stressability of the detonator element. Very great electrical reliability, even under unfavorable environmental conditions, is guaranteed by the integration of the individual elements, including the lead electrodes, in one common circuit without internal direct contacts. Even in very large production quantities, the manufacture of the detonator element according to the invention is possible according to the aforementioned process with comparatively little expenditure and very defined ignition behavior.

The detonator element according to the invention makes possible advantageous functioning and characteristics of the electric ignition arrangement, which functioning and characteristics could previously only be attained by external circuit techniques, i.e. by the separate arrangement of electronic assemblies. The very compact, mechanically stable, and electrically reliable structure makes possible relatively simple electric ignition means systems with functional features of high value. This is achieved by the direct integration of the ignition resistance, leads, and active and/or passive electronic components on the support with the aid of a suitable integration technique, for instance, the techniques of etching, screen printing, and/or thin-film deposition, especially of tantalum thin-film deposition. The detonator elements which can be manufactured in this manner have selected ignition properties and are therefore also called selective detonator elements.

The electronic element or elements can be formed, for example, as so-called two-terminal networks, which are arranged in one of the lead electrodes, electrically in series with the ignition resistance. These two-terminal networks, used for the adjustment of various ignition characteristics, can be, for instance, a Zener diode, a four-layer diode, a thyristor with a trigger diode, a transistor system with trigger behavior, or the like.

The Zener diode, connected in front of the ignition resistance, displaces the ignition limits, i.e. displaces the voltage correlated to the ignition probability between sure non-ignition and 100% ignition by the amount of Zener voltage towards higher voltages and thus towards the more insensitive side. A four-layer diode, used instead of the Zener diode, causes, besides the displacement of the ignition limits towards the insensitive side, the narrowing of these limits, i.e. a decrease in the voltage difference between sure non-ignition and 100% ignition.

In the combined two-terminal threshold switch consisting of thyristor and trigger diode, the thyristor is connected in series with the ignition resistance and the trigger diode is connected between the voltage source and the control input of the thyristor. The trigger diode causes the displacement of the ignition limits toward the more insensitive side and the thyristor causes their narrowing. The advantage of this two-terminal network resides in the fact that the adjustment of the ignition limits is possible with essentially less energy and within essentially broader ranges than with Zener or four-layer diodes.

Other functional properties can also be attained by employing more complex circuit arrangements in correspondence to the respective demands made. In this way even selective detonator elements, for example, can be realized in a compact structure, which elements only allow ignition within a quite specific voltage or current range, in order to achieve, for example, a protection against low stray voltages as well as against electrostatic discharges in the high voltage range. The electronic circuit structure for the limiting of the lower and upper ignition thresholds takes place in the conventional manner. For instance, for the lower ignition threshold, a so-called four-terminal network can be provided, which consists of a thyristor, trigger diode, and a matching resistor, and which is connected between the voltage source and the two lead electrodes of the ignition resistance. For the upper ignition threshold, for example, a thyristor connected in parallel to the ignition resistance can be provided as a fuse arrangement against overvoltage, the control input of this thyristor being connected between a Zener diode and a matching resistor, which are connected in series and which are, in turn, likewise connected in parallel to the ignition resistance.

In addition to these selective detonator elements adapted to the respective application, more generally usable systems can also be constructed in accordance with the principle of the present invention. In this way, the selective detonator element can be provided with e.g. an incorporated, i.e. internal, ignition energy storage arrangement, which is charged by an external ignition energy source to be connected to the detonator element. The energy pulse for ignition control or triggering the detonation is also fed in from the outside via a preferably electronic device connected to the detonator element at a predetermined time after charging the storage arrangement, and this energy pulse then causes the triggering of the detonator element dependent on the respective internal electronic structure of the detonator element. Thus, this detonator element is not only capable of being combined with various external detonation energy sources, but it can also be combined with different devices for applying the detonation pulse. Furthermore, it can be provided, for instance, that the detonation energy storage arrangement is connected externally, so that the detonator element can be combined with different storage arrangements.

The electronic components, of which at least one is provided, and the ignition resistance can, in principle, be arranged on different sides of the support. However, it is preferred that they are applied on one and the same side. The at least one electronic component is preferably arranged on one flat side of the support and, for example, can be covered with a metal housing in the form of a bell, hood, or the like which is placed on the support and cemented thereto for additional protection against mechanical stress. The ignition resistance is not covered by the housing, so that the primer charge can be applied on the ignition resistance. The housing can be connected to one of the lead electrodes in an electrically conductive manner and can serve for external contacting.

Alternatively, in accordance with an embodiment of the present invention, the electronic components, of which at least one is present, is completely embedded in an insulating member which contacts the support and exposes the ignition resistance. The insulating member is manufactured, for example, as an injection-molded component on the basis of a synthetic resin and is firmly connected to the adjacent surface of the support. Suitable casting resins include, for example, epoxy resins, unsaturated polyester resins, or isocyanate resins, which preferably contain fillers such as finely ground quartz or glass fibers to increase mechanical strength. A sealing compound completely surrounds the electronic component and supports the component on all sides in conjunction with the support, so that due to this advantageous transmission of force, the detonator element is stable even against very great stress.

According to another feature of the present invention, the insulating member is provided with a recess such as a penetrating axial recess for receiving the primer charge in operative connection with the ignition resistance and which exposes the ignition resistance. The insulating member thus simultaneously serves as a housing for the primer charge or the detonating material filled into the recess and pressed against the ignition resistance under corresponding pressure, so that an internal contact is established between both the resistance and charge. The recess is preferably formed centrally in the insulating member and the ignition resistance is appropriately arranged on the support. Further, the insulating member is preferably formed with an outer surface which continues as an extension of the outer surface of the support. The cross section of the insulating member and the support is perferably circular, but could also be square, hexagonal, or the like, for example.

The combination of the selective detonator element with an insulating member produces, in ad advantageous manner, an extremely compact and mechanically stable electronic detonator element with an electrical input and a pyrotechnical output.

A particularly advantageous form of the detonator element according to the present invention is provided in that the support is made of a piezoelectric material with piezoelectrically active electrodes surfaces located opposite each other and that at least one of the electrode surfaces is provided with at least one contact for arranging the electrical circuit. The support serves, on the one hand, as a mechanical element to receive the circuit with the ignition resistance and at least one electronic component and, on the other hand, as an electric element to generate the ignition energy and optionally the triggering pulse. Due to this dual function of the support made of piezoelectric material, especially a piezoelectric ceramic, an extremely compact electronic detonator element results which no longer requires any external electric energy source. The piezoelectric support, e.g. when used as a projectile detonator at launch and/or at impact on the target, can be deformed by the impact forces resulting during this process in such a way that detonation energy is generated. But this can also be generated, for example, in that a piston, accelerated with the aid of compressed gas, is driven against the support.

Ignition systems with very advantageous properties can be realized by this mechanical integration of the piezoelectric support and the electric circuit. In this connection, the ignition resistance and the electronic components, of which at least one is utilized, are also preferably arranged on the same upper side of the support, which side faces toward the primer charge. At the same time, this side bearing the circuit represents one of the two electrode surfaces located opposite each other which are piezoelectrically active, i.e. which receive the ignition energy and optionally the control energy, in that this side is coated with a corresponding metal layer firmly connected to the support. The conductor paths of the circuit are connected to the electrode surface in an electrically conducting manner by way of only one or optionally also several defined connecting tongues, respectively, according to the circuit structure, but are otherwise electrically separated from the metal layer of the electrode surface by a metal-free insulating zone of suitable width. In this connection, the individual surfaces of the conductor paths are to be kept so small that the electrical charges occurring on these surfaces due to the piezoelectric effect are sufficiently slight to be unable to trigger any undesired electronic control processes in the circuit, even under unfavorable conditions.

At least the ignition resistance, but respectively, according to circuit structure, likewise the one or the other electronic module, must be connected to the two piezoelectrically active electrode surfaces. In addition, an electrically conductive, bridge-shaped connection from the elements located in the one electrode surface to the opposite electrode surface can be produced via the outer surface of the support. However, instead of this arrangement, it is preferred to establish through-contact with the support by having the ignition resistance, and optionally, the at least one electronic component connected in an electrically conducting manner to the piezoelectrically active electrode surface by way of at least one perforation formed in the support. For instance, the perforation embodied as a cylindrical bore can be coated only on its wall with a layer of electrically conductive material or also completely filled in with such a material. In contrast to the aforementioned external contacting on the outer surface of the support, the through-contact, of which at least one is present, provided inside of the support has the essential advantage that, in an arrangement of the ignition resistance and at least one electronic component within one essentially annular piezoelectrically active electrode surface, the radial interruption of said electrode surface for the purpose of contacting via the outer surface can be eliminated.

These and further objects, features and advantages of the present invention will become more obvious from the following description when taken in connection with the accompanying drawings which show, for purposes of illustration only, several embodiments in accordance with the present invention; and wherein the detonator elements are illustrated on an enlarged scale.

Figure 2:
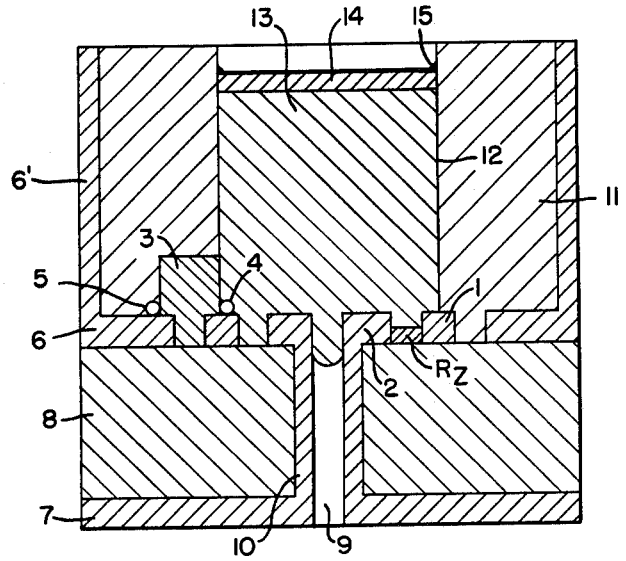
Figure 3:
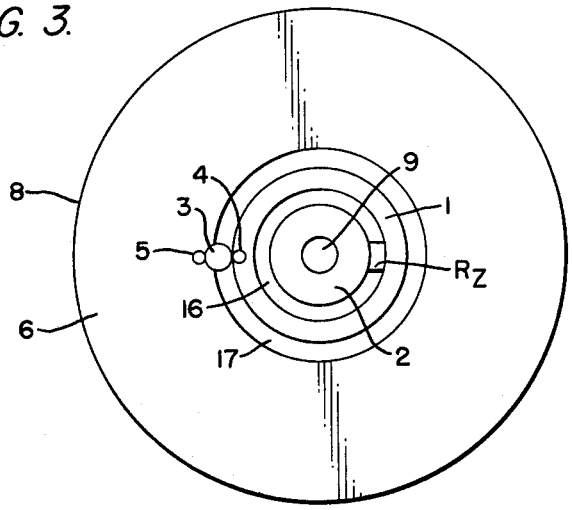
Figure 4:
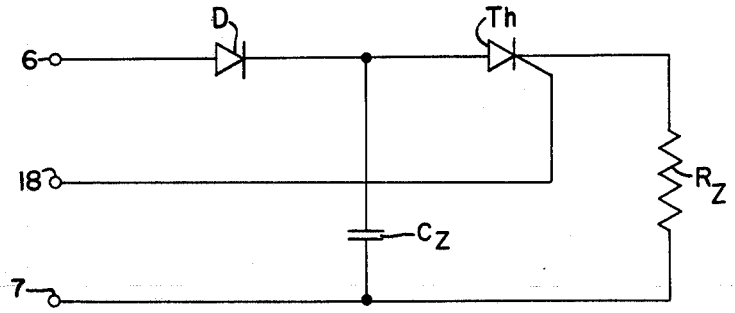
Figure 5A:
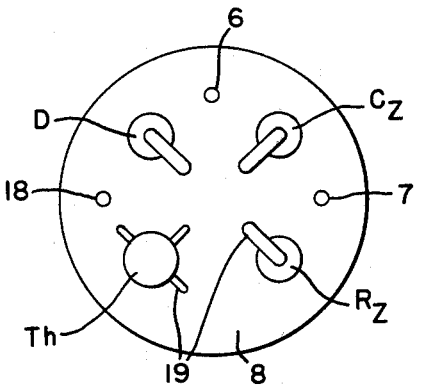
Figure 5B:
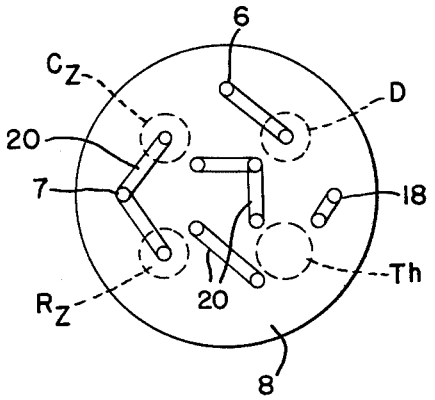
Figure 5C:
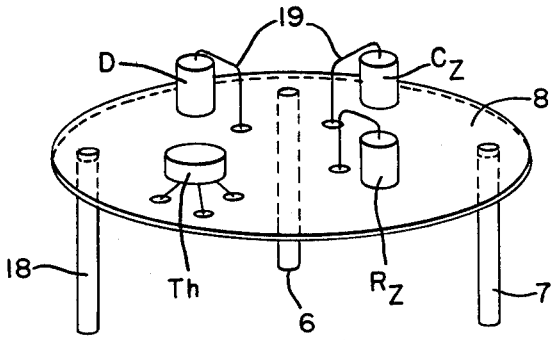
Figure 6:
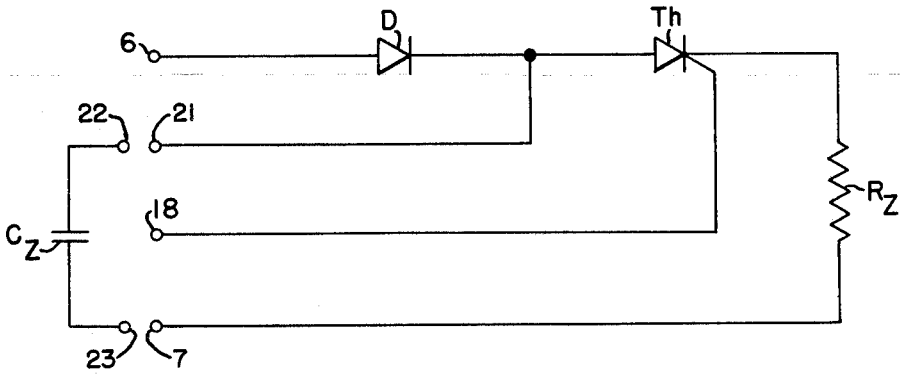
Figure 7:
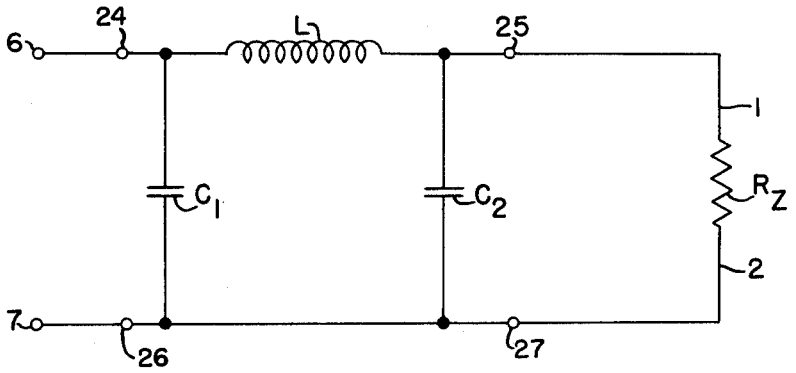
Figure 8:
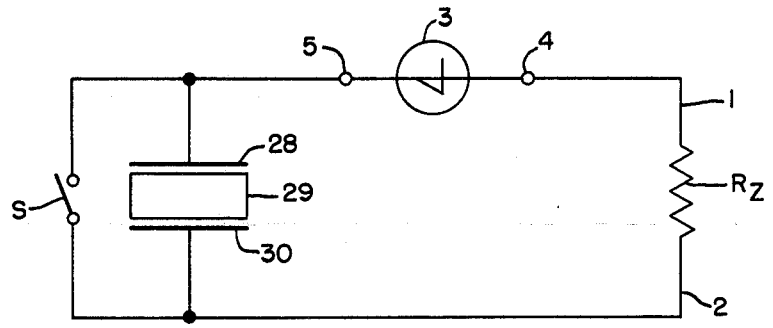
Figure 9:
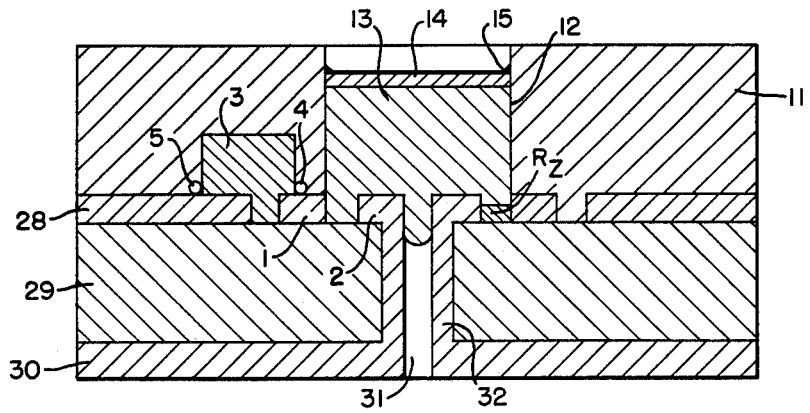
Figure 10:
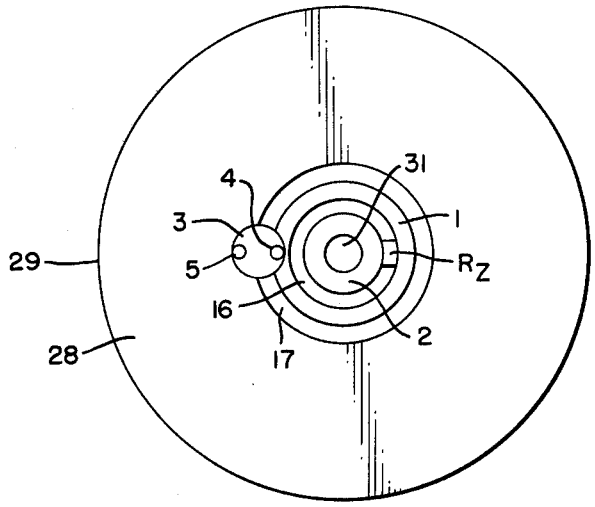
Figure 11:
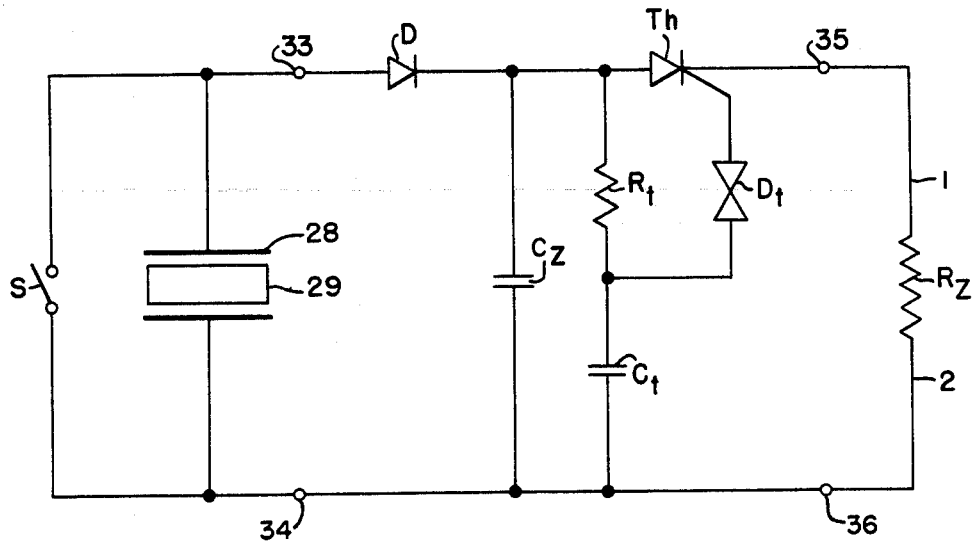
Figure 14:
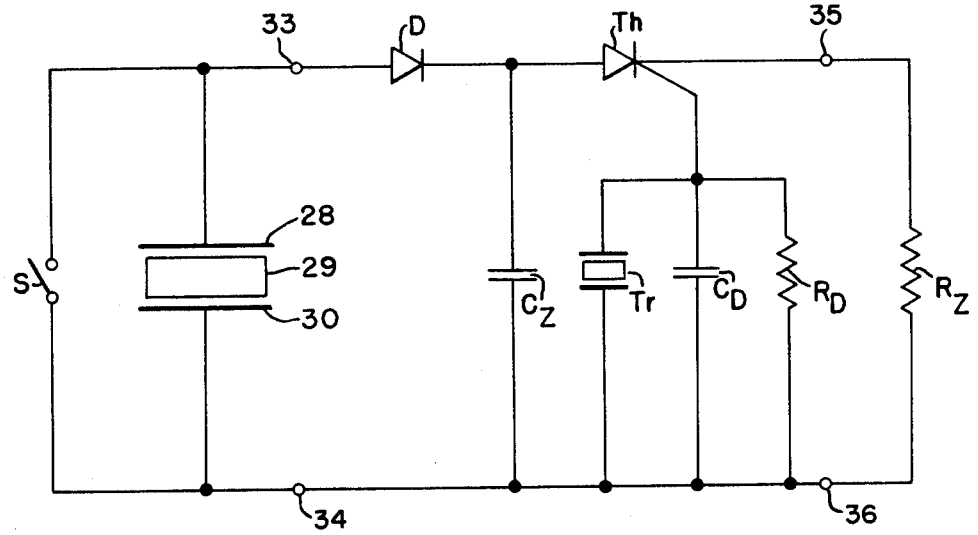
Figure 12:
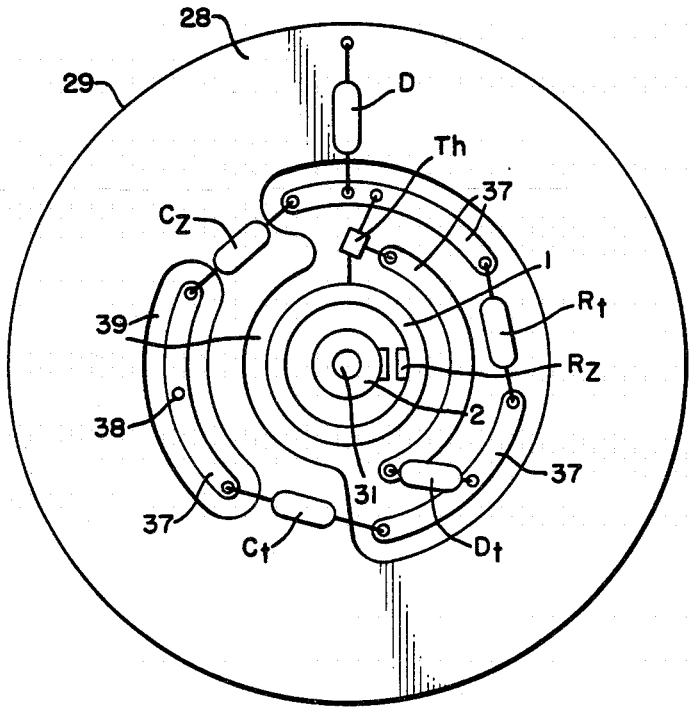
Figure 13:
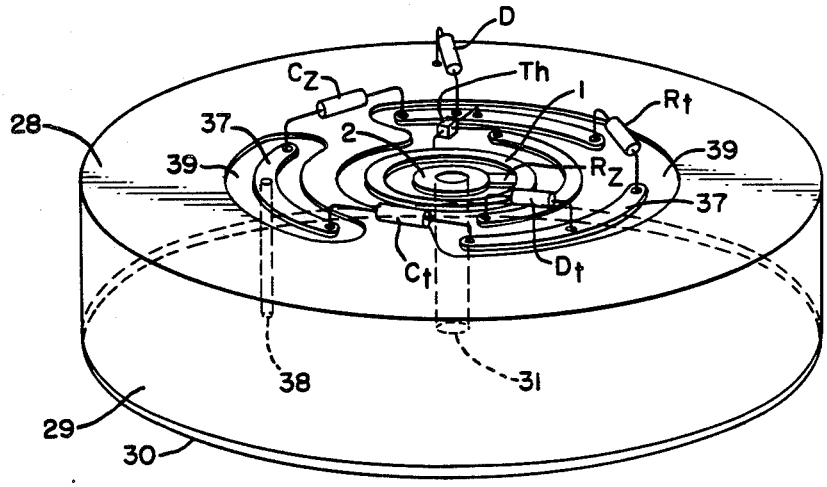

FIG. 1 is a circuit diagram of a detonator element with a two-terminal network, FIG. 2 illustrates a detonator element with a primer charge and insulation member in longitudinal section, FIG. 3 is a top view of another detonator element in accordance with the present invention, FIG. 4 is a circuit diagram of a detonator element with external initiation of ignition, FIGS. 5*a* through 5*c* illustrate different views of connection of the detonator element, Figure FIG. 6 is a circuit diagram of a detonator element with an external detonation energy storage arrangement and external initiation of ignition, FIG. 7 is a circuit diagram of a detonation element which is insensitive to high frequency, FIG. 8 is a circuit diagram of a piezoelectric detonator element with a two-terminal network, FIG. 9 illustrates a piezoelectric detonator element with a primer charge and insulating member in cross section, FIG. 10 is a top view of a detonator element similar to that of FIG. 9, FIG. 11 is a circuit diagram of a piezoelectric detonator element with a delay arrangement, FIG. 12 is a top view of a piezoelectric detonator element with a delay arrangement, FIG. 13 is a perspective view of a detonator element similar to that of FIG. 12, and FIG. 14 is a circuit diagram of a piezoelectric detonator element with impact initiation.

Referring now to the drawings, wherein like reference numerals are utilized to designate like parts throughout the several views, there is shown in FIG. 1 an ignition resistance $R_Z$ with its lead electrodes 1, 2 connected in series with the electronic component 3 embodied as a two-terminal or two-connection point network, for example, a four-layer diode. The electrical connection takes place at the connecting points 4, 5 with the detonation energy source, not shown, being connectable at the electrode connections 6, 7.

FIG. 2 illustrates a possible embodiment of this detonator element. The ignition resistance $R_Z$ with its lead electrodes 1, 2 is formed as a metal-layer detonating arrangement in accordance with DOS No. 2,020,016, on the flat upper side of the support 8 of e.g. aluminum oxide ceramic. The lead electrode 1 is connected by way of the soldered point 4 to the two-terminal network 3, which, in turn, is connected via the soldered joint 5 to the external electrode 6 which is formed as an annular surface. The other lead electrode 2 is connected by way of an electrically conductive layer 10 of an axial perforation 9 of the support 8 to an electrode 7 formed on the flat lower surface of the support, which electrode is essentially shaped like a circular disc. Arranged on the upper side of the support 8 and fixedly attached thereto is an insulating member 11 made of epoxy resin with finely ground quartz, in which insulating member component 3 is firmly embedded on all sides. The insulating element 11 has a central axial recess 12, so that a sealing compound does not cover the ignition resistance $R_Z$. The detonating material or primer charge 13, covering the ignition resistance $R_Z$, is pressed into place into the recess 12 and is secured against external influences with a cover 14 made of paper, lead-tin foil, or the like and a protective varnish coating 15. For improved contact with a metal housing, not shown, which receives the detonator element, the insulating member 11 is coated on its cylindrical outer surface with a metal layer 6', which is a continuation of the electrode 6. The metal layers are applied by, for example, printing, sputtering, precipitation with electroplating and/or chemical techniques. However, metal foils treated in accordance with etching technology and cemented thereto could also be used. Here, as in the other examples, too, the thickness of the metal layers is shown greatly enlarged in comparison to the other dimensions of the detonator element for reasons of technical illustration. As viewed from the outside, the detonator element with the insulating member 11 is advantageously formed in a rotationally symmetrical manner.

FIG. 3 shows in top view, another detonator element wherein the ignition resistance $R_Z$ is arranged on the upper face of the support 8 and is formed as an ignition bridge connected to the support 8 over its entire surface, with the component 3 soldered thereto and with the conductor paths or conductor surfaces embodied as metal layers. The lead electrodes 1 and 2 are formed as annular surfaces which are mutually insulated up to the ignition resistance $R_Z$ by the uncoated annular surface 16. The outer electrode 6 is likewise embodied as an annular surface and is separated with respect to the lead electrode 2 by the uncoated annular strip 17. The component 3 is connected to the annular surfaces 2 and 6 in an electrically conductive manner.

In the selective detonator element shown in FIG. 4, three outer connection electrodes 6, 7, and 18 are provided. The terminals 6 and 7 make possible the connection to an external detonation energy source, not shown, in order to charge the internal detonation energy storage arrangement or the detonator capacitor $C_Z$. The diode D prevents the undesired discharging of the detonation capacitor by way of terminals 6, 7. After charging the detonation capacitor $C_Z$, a trigger voltage is applied at a predetermined time between terminals 18 and 7 to turn on the thyristor Th, so that the charge stored in the detonation capacitor is conducted by way of the ignition resistance $R_Z$. When this detonation element is used in a projectile detonator, the detonation capacitor $C_Z$ is charged, for instance, during the firing by a temporally limited current surge. Thereafter, the connection between the electrodes 6, 7 and the detonation energy source can be interrupted. The external initiation of the detonation via the electrodes 18, 7 can be optionally designed in correspondence with the respective application. The triggering of detonation can occur at any point in time within a maximum time span according to the energy supply of the detonation capacitor $C_Z$. The maximum time span is set by the size of the detonation capacitor, which determines the leakage currents and thus the duration of the charge storage.

In FIGS. 5*a* through 5*c*, a possible arrangement of the electronic components D, $C_Z$, and Th and the ignition resistance $R_Z$ with the pertinent conductor path linkage on the support 8 is shown, which support is a circular disc made of e.g. an epoxy resin plate. FIG. 5*a* shows the upper side of the detonator element, FIG. 5*b* shows its lower surface, and FIG. 5*c* shows a perspective view. The lead wires of the individual elements are designated by reference numeral 19 and the electrically conductive conductor paths on the lower surface of the support 8 are designated by reference numeral 20. The ignition resistance $R_Z$ is symbolically represented. The ignition resistance is preferably formed as an ignition bridge or an ignition gap in accordance with DOS No. 2,020,016, i.e. connected over the entire surface with the support 8. However, the ignition resistance could also be formed e.g. as an incandescent wire, both ends of which only contact the support 8 and which wire is connected to the support.

FIG. 6 shows a circuit variant similar to that in FIG. 4, wherein the detonation capacitor $C_Z$ with its contacts 22, 23 can be externally connected to the electrodes 21, 7 of the selective detonator element, and thus can be freely selected according to the respective requirements of the application. In this detonator element, which in comparison to FIG. 4 is even more generally usable, the four electrodes 6, 7, 18, and 21 lead outwardly. The electrical detonation energy is fed into the system via the electrodes 6 and 7 and is stored in the detonation capacitor $C_Z$. The ignition pulse is applied by way of the electrodes 18, 7 with the aid of an external triggering of the ignition, not shown.

In order to make the detonator element insensitive to high-frequency, electrical a.c. fields, this detonator element can be equipped with a high-frequency filter according to FIG. 7. This so-called $\pi$-filter is formed as a four-terminal network with terminals 24 through 27. The terminals 24 and 26 are connected to the outer electrodes 6 and 7, which are to be connected to the detonation energy source, and the terminals 25 and 27 are connected to the lead electrodes 1 and 2 of the ignition resistance $R_Z$, preferably by soldering. The four-terminal network has the inductance L connected in series with the ignition resistance $R_Z$ with the two capacitors $C_1$ and $C_2$ being connected in parallel with the ignition resistance. With this integrated arrangement of the ignition resistance $R_Z$ and the high-frequency fuse arrangement constructed of passive electronic components, i.e. their fixed arrangement next to each other on one common support, a selective detonator element is obtained which enables a specifically desired insensitivity to high-frequency influence especially in the military field, and particularly in fire control systems using radar.

FIG. 8 shows a circuit diagram for a piezoelectric detonator element, the ignition resistance $R_Z$ of which with its one lead electrode 1 is connected via the two-terminal network 3 having terminals 4, 5 to an upper piezoelectrically active electrode surface 28 of the support 29 made of piezoelectric material. The other lead electrode 2 of the ignition resistance is firmly connected to the lower piezoelectrically active electrode surface 30 in an electrically conductive manner. The electrode surfaces 28, 30 are embodied as metal layers which are firmly arranged on the support 29, which is preferably shaped like a circular disc, which surfaces are shown here only for reasons of technical illustration at a distance from the two front surface of the support 29.

A mechanical safety switch S connected parallel with the piezoelectric element 28, 29, 30 serves, for example, to short-circuit the electrode surfaces during the pressing into place of the primer charge 13, shown in FIG. 9, which may cause possible pressure stress of the piezoelectrically active electrode surfaces 28, 30 so that possible charge separations are immediately cancelled again and an undesired initiation of the primer charge 13 is safely avoided. For example, a contact bracket can be provided in the pressing tool for this short circuit, which contact bracket contacts both electrode surfaces. However, the mechanical safety switch may also be formed in a conventional manner in such a way that it guarantees transport safety, safety in the barrel, and the safety of the projectile after leaving the barrel when the detonator element is used for a projectile detonator with energy generation upon impact on the target. Such a safety switch can also be provided in detonator elements without a piezoelectrical energy source.

The selective piezoelectrical detonator element shown in FIG. 9 corresponds to that of FIG. 2 in its essential parts. However, in contrast thereto, the support 29 is made of a piezoelectric material, especially a piezoelectric ceramic material. The upper, piezoelectrically active electrode surface 29 is formed as an annular metal layer of maximum size. In contrast, the other conductor paths located on the upper face of the support 28 are formed as small as possible, to keep the electrical charges occurring on them during pressure stress so small that no electrical control processes in the circuit could be triggered thereby. The detonation energy is generated between the piezoelectrically active electrode surface 28, 29 upon the effect of a corresponding force aimed vertically with respect to these surfaces. The lead electrode 2 of the ignition resistance $R_Z$ is connected to the lower electrode surface 30 by way of an axial perforation 31. The continuous bore 31 provided for through contact has a metal layer 32. Here, too, the ignition resistance $R_Z$, in the form of an ignition bridge, is directly incorporated into the circuit, which, in turn, is embedded in the mechanically firm insulating element 11 made of a sealing compound such as epoxy resin with filler. The ignition resistance $R_Z$ with the lead electrodes 1, 2 is applied to the support 29 preferably in accordance with DOS No. 2,020,016, wherein the lead electrodes are advantageously made of gold. Preferably used for this, as well as for applying the other metal layers, is the cathode sputtering technique.

This detonator element, which is rotationally symmetrical as viewed from the outside, is provided with a primer charge 13 arranged in the recess 12, which primer charge contacts the ignition resistance $R_Z$, such that the detonator element represents a compact, integrated, mechanical-electric-pyrotechnical unit which can be utilized, for example, as an impact detonator having a defined lower ignition threshold, in that incorporated as a two-terminal network 3 is a Zener diode, a four-layer diode, a replacement circuit having a Zener diode or four-layer diode character, a thryistor with a trigger diode arranged at the control input, or the like. Upon impact of the missile, especially of a projectile, on the target the piezoelectric support 29 is mechanically compressed by an impact mass correlated thereto in the conventional manner or by the sound wave spreading out in the missile. The charge released by the piezoelectric effect is stored in the support 29 until the threshold voltage of the two-terminal network 3 is reached. After surpassing the threshold value, the thusly stored charge is switched to the ignition resistance $R_Z$. The electrical ignition is thus initiated and the pyrotechnical output of the detonator element activates the further operation of the impact detonator.

FIG. 10 shows a detonator element with the same construction as that in FIG. 9, but with somewhat smaller cross-sectional dimensions. It can clearly be seen that the conductor paths 1, 2 are formed in a very small manner in contrast to the piezoelectrically active electrode surface 28. Preferably, they are formed so small that a satisfactory current flow to the ignition resistance $R_Z$ is barely attained. In this connection, the charge occurring because of the piezoelectric effect in the conductor paths 1, 2 is sufficiently slight that these conductor paths behave like quasi piezoelectrically inactive surfaces and cause no impairment in the circuit of the detonator element.

In FIG. 11, a circuit embodiment of a piezoelectric time delay igniter is shown which has an ignition threshold adapted to the respective task posed and which can be employed, for example, as a projectile detonator. The detonation capacitor $C_Z$ is connected in parallel to the support 29 made of piezoelectric material and the diode D is connected before the detonation capacitor to prevent a discharging of this detonation capacitor during a relief of pressure on the support 29. The delay after charging the detonation capacitor $C_Z$ occurs with the aid of the timing element formed of the resistor $R_t$ and capacitor $C_t$ and the trigger diode $D_t$ acting as a threshold switch. The trigger diode is connected to the control input of the thyristor Th, whose output is connected to the lead electrode 1 of the ignition resistance $R_Z$, its other lead electrode 2 being connected in an electrically conductive manner to the lower piezoelectrically active electrode surface 30 of the support 29. The aforementioned electronic components comprise a four-terminal network with terminals 33 through 36. The mechanical safety switch S, constructed in the known manner, serves to insure transport safety and in use as an impact detonator also to maintain the safety of the projectile in the barrel of a weapon and the safety of the projectile after leaving the barrel. A suitable short circuit device prevents the undesired initiation of the detonator element when the primer charge is inserted into the detonator element.

The operation is as follows: When the safety switch S is opened, a separation of charge takes place during mechanical compression of the support 29, e.g. upon impact on the target. The resulting charge is stored in the detonation capacitor $C_Z$ via the diode D. After a delay period, predetermined with the timing element $R_tC_t$ as well as with the trigger diode $D_t$, has elapsed, the thyristor Th is triggered. The charge of the detonation capacitor $C_Z$ can then be discharged via the ignition resistance $R_Z$, whereby the detonation of the primer charge is initiated.

Instead of upon impact, the piezoelectric support 29 can also be exposed to pressure stress during the launch by the thereby occurring shock-like accelerative forces. The delay circuit then causes the self-disintegration of the projectile after a given period of time, in case the triggering by means of another provided impact detonator did not previously occur.

Furthermore, the resistor $R_t$ can be, for instance, temperature-dependent, formed as a thermistor, in order to attain, for example, shorter delay times and thus a temperature compensation at low ambient temperatures in view of the then more slowly proceeding reactions of the systems disposed after the detonator element and pertaining to a projectile.

A possible arrangement of the individual elements of the circuit according to FIG. 11 on the support 29 is shown in FIG. 12. The ignition resistance $R_Z$, here an ignition gap, is formed nearly at the center of the piezoelectric, pill-shaped support 29, again preferably in correspondence with DOS No. 2,020,016. The external, annular lead electrode 1 is connected to the rest of the circuit by way of the thyristor Th and additional conductor paths 37. The inner annular lead electrode 2 is connected in an electrically conductive manner to the piezoelectrically active electrode surface 30 located on the lower face of the support 29 by way of the through-contact 31. The conductor path 37, connecting the detonation capacitor $C_Z$ and the capacitor $C_t$ to each other, is connected via the perforation 38 to the lower electrode surface 30 in an electrically conductive manner. Even in this circuit arrangement, the lead electrodes 1, 2 and the conductor paths 37 are to be kept as small as possible, so that no significant charges occur on said paths, which could possibly trigger inadmissible electronic control processes. These surfaces are separated from the piezoelectrically active electrode surface 28 by the metal-free, electrically nonconductive recesses 39. To attain an electrode surface 28 of maximum size, this electrode surface extends between the conductor paths 37.

FIG. 13 depicts in perspective view, a spatial representation of a detonator element corresponding to FIG. 12, before the electronic components have been embedded into the mechanically firm insulating member, which serves as a detonation charge housing at the same time. The through contacts 31 and 38 can be seen clearly, which establish the connection to the lower electrode surface 30. The conventional safety switch S indicated in FIG. 11 is not shown. Its connecting contacts are to be joined to the electrode surfaces 28, 30. The ignition resistance $R_Z$ is again formed as an ignition bridge. Otherwise, the construction corresponds to that according to FIG. 12.

Finally, in FIG. 14 another piezoelectric detonator element is shown which is especially suited for projectile detonators. In this variant, the detonation energy is generated upon launch at the piezoelectric support 29, to which an impact mass exerting pressure is correlated in a known manner. A charge reversal of the detonation energy via the diode D to the detonation capacitor $C_Z$ takes place and the detonation energy is stored in the capacitor during the flight phase. Triggering occurs upon impact on the target, in that in another piezoelectric element, the trigger member Tr generates electrical energy due to the shock on impact, whereby the thyristor Th is turned on, in connection with the attenuation circuit of the resistor $R_D$ and capacitor $C_D$ and the charge is switched from the detonation capacitor $C_Z$ to the ignition resistance $R_Z$. The attenuation circuit $R_D$ and $C_D$ serves to attenuate the oscillating processes started on impact and serves to adapt the sensitivity to the respective task posed, in that a more or less large portion of the energy generated in the trigger member is again dissipated in this circuit. The trigger member Tr can be a separate, piezoelectric disc or pill of smaller dimensions which is arranged in the detonator housing in addition to the support 29. However, the trigger member can also be formed as an additional, active electrode surface on the support 29, which trigger member is smaller than the electrode surface 28, since the turning on of the thyristor Th requires only a comparatively small amount of energy.

The circuit structure for a delay according to FIGS. 11 and 12 can also be provided in detonator elements without piezoelectric supports. Combinations of the various circuit variants are also possible. Thus, the impact detonation according to FIG. 14 can be combined, for example, with the self-disintegration according to FIG. 11 in one detonator element.

The assembly of these selective detonator elements, especially metal-layer detonating elements, occurs—as stated—in a compact, rugged construction and preferably in such a way that a component, rotationally symmetrical from the outside, is obtained with detonating material arranged therein. This component has high operating reliability with comparatively little expenditure and with great insensitivity.

While we have shown and described various embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

What is claimed is:

1. An electrical detonator element comprising:

a support of an electrically nonconductive material;

an electric circuit provided on the support for enabling detonation, the electric circuit including an ignition resistance with lead electrodes connected thereto and at least one electronic component means, the ignition resistance and the at least one electronic component means being electrically connected in the electrical circuit and each being separately arranged on the support; and a mechanically firm insulating member contacting the support so as to at least partially cover the at least one electronic component means, the at least one electronic component means being embedded in the insulating member, the insulating member being provided with a recess in the region of the ignition resistance which exposes at least the ignition resistance, the recess extending through the insulating member and being adapted for receiving a primer charge in operative connection with the ignition resistance.

2. A detonator element according to claim 1, wherein the support is provided with at least one perforation extending therethrough, the perforation having an electrically conductive material therein for enabling connection of the ignition resistance in the electric circuit.

3. A detonator element according to claim 2, wherein the electric circuit provided on the support is connectible to an external power source for enabling detonation.

4. A detonator element according to claim 1, wherein the support is formed of a piezoelectric material having piezoelectrically active electrode surfaces located opposite each other, at least one of the electrode surfaces being provided with at least one cutout for arranging the electrical circuit.

5. A detonator element according to claim 4, wherein the support is provided with at least one perforation extending therethrough, at least the ignition resistance being connected in an electrically conducting manner to the piezoelectrically active electrode surface located opposite thereto by the at least one perforation in the support.

6. A detonator element according to claim 5, wherein the at least one electronic component means is connected in an electrically conducting manner to the piezoelectrically active electrode surface located opposite thereto by the at least one perforation in the support.

7. A detonator element according to claim 4, wherein the piezoelectric material of the support and the piezoelectrically active electrode surfaces are responsive to force applied thereto for providing the power for enabling detonation.

8. A detonator element according to claim 1, wherein the at least one electronic component means include at least one of a diode, transistor, thyristor, resistor, capacitor, and inductor.

9. A detonator element according to claim 1, wherein the at least one electronic component means comprises means having at least two connection points in the electric circuit.

10. A detonator element according to claim 1, wherein the support is a circular disc-like member.

11. A detonator element according to claim 1, wherein the support has an upper and lower surface, at least the ignition resistance and the at least one electronic component means being disposed on the upper surface of the support, the insulating member having an upper and lower surface, the lower surface of the insulating member contacting at least one of the upper surface of the support and the at least one electronic component means.

12. A detonator element according to claim 11, wherein the recess of the insulating member extends through the insulating member from the lower surface to the upper surface thereof.

* * * * *